US005147070A

United States Patent [19]

Iwamoto

[11] Patent Number: 5,147,070

[45] Date of Patent: Sep. 15, 1992

[54] POURING PLUG FOR A CONTAINER HAVING A TUBULAR BLADE

[75] Inventor: Hidechika Iwamoto, Tokyo, Japan

[73] Assignee: Yamato Kakozai Co., Ltd., Tokyo, Japan

[21] Appl. No.: 671,924

[22] Filed: Mar. 20, 1991

[30] Foreign Application Priority Data

Mar. 23, 1990 [JP] Japan .....2-30450[U]

[51] Int. Cl.[5] ..... B67D 5/06

[52] U.S. Cl. ..... 222/83; 222/81; 222/541

[58] Field of Search ..... 222/81-83.5, 222/89, 91, 541; 220/265, 267, 277, 278

[56] References Cited

U.S. PATENT DOCUMENTS

| | | | |
|---|---|---|---|
| 4,214,675 | 7/1980 | Schmit | 222/83 |
| 4,483,464 | 11/1984 | Nomura | 222/83 |
| 4,493,438 | 1/1985 | Rutter | 222/83 |
| 4,624,392 | 11/1986 | Malpas et al. | 222/83 |
| 4,846,236 | 7/1989 | Deruntz | 222/81 X |
| 5,020,690 | 6/1991 | Kishikawa | 222/83 |

FOREIGN PATENT DOCUMENTS

| | | | |
|---|---|---|---|
| 62027 | 4/1985 | Japan | 222/83 |
| 62-58333 | 4/1987 | Japan . | |
| 62-58334 | 4/1987 | Japan . | |
| 62-58335 | 4/1987 | Japan . | |
| 63-156928 | 10/1988 | Japan . | |
| 4655 | 1/1990 | Japan | 222/83 |

*Primary Examiner*—Michael S. Huppert
*Assistant Examiner*—Kenneth DeRosa
*Attorney, Agent, or Firm*—Wenderoth, Lind & Ponack

[57] ABSTRACT

A pouring spout for a container has a tubular body to be mounted on a container wall, the inner surface of the tubular body having a guiding recess therein extending parallel to the axis of the tubular body, the recess having a greater width at the portion thereof toward one end of the tubular body and a shoulder at an end corresponding to another end of the tubular body; a tubular blade movably mounted within the tubular body and having a longitudinal projection on the outer surface thereof and an outward projection at the end of the longitudinal projection corresponding to the one end of the tubular body, the longitudinal projection being slidably engaged in the recess for guiding movement of the tubular blade into the tubular body in a direction from the one end toward the other end, the shoulder having a notch portion in an inner peripheral edge having a cross-sectional shape different from the cross-sectional shape of the longitudinal projection for blocking movement of the tubular blade in the direction at a set position within the tubular body by engagement of the longitudinal projection with the shoulder at the position of the notch portion, and the shoulder being deformable for permitting the longitudinal projection to fit into the notch and permit movement of the tubular blade in the direction past the set position until the outward projection engages the shoulder; and a cap mounted over the tubular body.

2 Claims, 2 Drawing Sheets

POURING PLUG FOR A CONTAINER HAVING A TUBULAR BLADE

BACKGROUND OF THE INVENTION

1. Field of the Invention

This invention relates to a pouring plug to be mounted on a container formed from a sheet material in which synthetic resin films are laminated on the inside and outside of a sheet of cardboard.

2. Description of the Prior Art

In the past, containers of a flat top type or a gable top type formed from a sheet material as described above have been used as packaging containers for juice, milk, tea and the like. Various pouring plugs to be mounted on a portion in which an opening of such containers is to be formed have been proposed.

The aforementioned pouring plug normally comprises a tubular body to be mounted on a container wall, a cap fitted over the tubular body and a tubular blade mounted movably up and down within the tubular body so that in unsealing the container, the tubular blade is moved downward within the tubular body whereby a seal portion such as a synthetic resin film, an aluminum foil or the like placed over a through hole which is to be an opening of the container is ruptured and opened.

In the pouring plug having such a construction, the tubular blade mounted within the tubular body can be temporarily fixed at a position in which the blade is at the highest position within the tubular body (position in which the tubular body substantially coincides with the upper end edge of the tubular blade), that is, a set position, and at a position in which the blade is at the lowermost position within the tubular body (position in which the upper end edge of the tubular blade is close to the lower end edge of the tubular body), that is, an unsealed position, respectively.

In mounting the tubular body on the container wall, an annular collar provided around the lower end of the tubular body is thermally mounted on the container wall. When the tubular blade protrudes from the lower end of the tubular body, the mounting operation becomes difficult.

Further, when the tubular blade is moved downward to rupture and open the seal plate, the whole tubular blade sometimes passes through the through hole and falls into the container, which is unsanitary.

Pouring plugs in which a tubular blade can be temporarily fixed at a predetermined position within the tubular body so far known include a construction wherein an annular projection is provided on the outer wall of a tubular blade and an annular recess or annular projection in engagement with the annular projection is provided on the inner wall of the tubular body (Japanese Utility Model Laid-open Nos. 62-58333 and 62-58334), a construction wherein the inside diameter of a lower portion of the tubular body is formed so as to be gradually smaller, whereas the outside diameter of an upper portion of the tubular blade is formed so as to be gradually larger to restrict passage (Japanese Utility Model Laid-open No. 62-58335), and a construction wherein a longitudinal groove is provided in the inner wall of the tubular body, a projection fitted in the longitudinal groove is provided externally of the upper portion of the tubular blade, and the projection is engaged with the lower shoulder of the longitudinal groove (Japanese Utility Model Laid-open 63-156928).

In the constructions of the conventional pouring plugs as described above, the construction wherein the annular recess or annular projection is provided on the inner wall of the tubular body has a problem in that molds used to manufacture the tubular body become complicated.

Furthermore, the construction wherein the longitudinal groove is provided in the inner wall of the tubular body, and the projection is provided externally of the upper portion of the tubular blade has a problem in that in setting the tubular blade in the tubular body, it is necessary to accurately adjust the position of the longitudinal groove relative to that of the projection, making automatic assembly difficult.

SUMMARY OF THE INVENTION

It is an object of this invention to provide a pouring plug for a container in which a tubular blade can be temporarily fixed at a position in which the tubular blade is set and at a position in which the tubular blade is movable downward, respectively. A further object of the invention is to provide a pouring plug for a container which can overcome the problems described above.

A pouring plug for a container according to the present invention comprises a tubular body to be mounted on a container wall, a tubular blade vertically movably mounted within the tubular body and a cap fitted over the tubular body. Such a pouring plug is characterized in that a longitudinal projection is provided on the outer surface of the tubular blade, an outward projection is provided above the longitudinal projection, a recess for guiding vertical movement of the outward projection is provided internally of the tubular body, the recess having its width wider on the end toward the tubular body, a shoulder opposite to the outward projection is provided at the lower part of the recess, the shoulder being also opposed to the lower end of the longitudinal projection when the tubular blade is set.

The aforesaid shoulder is engaged with the lower end of the longitudinal projection or the outward projection to define the downward nmovement of the tubular blade. However, it is necessary to release the engagement with the lower end of the longitudinal projection when the container is opened. Therefore, it is desirable that the shoulder be formed with a cut portion different in shape from the cross-sectional shape of the longitudinal projection, and the cut edge is brought into engagement with the lower end of the longitudinal projection to facilitate release of engagement.

It is further desirable that since the tubular blade is inserted into the tubular body for assembly, the recess be provided over the whole inner peripheral surface of the tubular body.

In the pouring plug for a container according to the present invention, the lower end of the longitudinal projection provided on the outer surface of the tubular blade and the outward projection are engaged with the shoulder at the lower portion of the recess provided in the inner surface of the tubular body, and the tubular blade is temporarily fixed at a set position and at a down position, respectively.

There is thus provided a construction in which an annular access and an annular projection are eliminated from the inner surface of the tubular body and the outer surface of the tubular blade, and a projection and a recess along the length of the tubular body and the tubular blade are provided. This can avoid the complexity of molds for manufacturing the tubular body and the tubular blade.

Furthermore, the width of the recess engaged with the outward projection of the tubular blade is made wider at the opening end, and therefore, the tubular blade can be easily assembled into the tubular body even if the outward projection is not correctly located relative to the recess.

BRIEF DESCRIPTION OF THE DRAWINGS

These and other objects, features and advantages of the present invention may be more clearly appreciated by reading the remainder of the specification in which some preferred embodiments will be described in further detail by referring to the accompanying drawings, in which.

DESCRIPTION OF THE PREFERRED EMBODIMENTS

An embodiment of this invention will be described with reference to the drawings.

Figure 1:
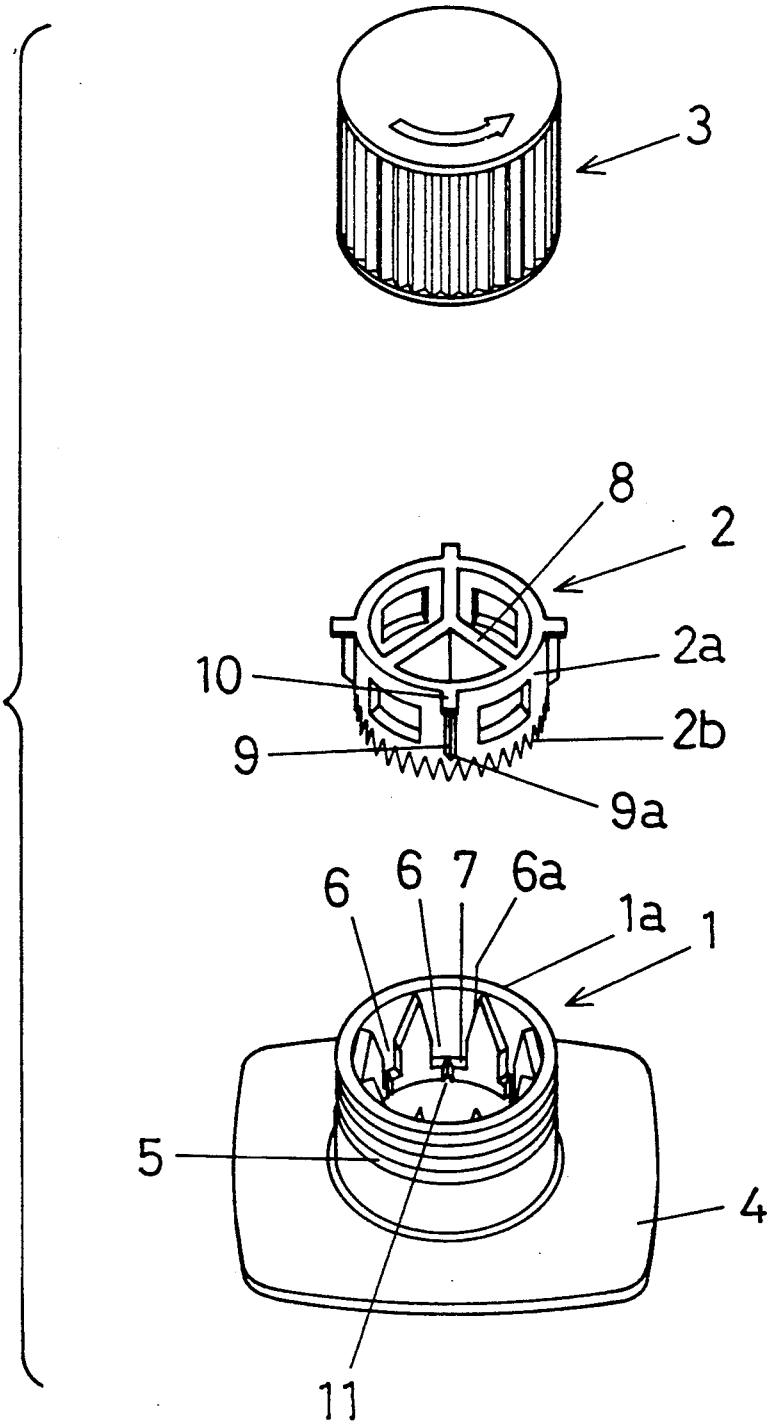
FIG. 1 is an exploded perspective view of an embodiment of this invention.

FIG. 1 shows in an exploded view a pouring plug for a container according to the embodiment. Reference numeral 1 denotes a tubular body, 2 a tubular blade, and 3 a cap.

The tubular body 1 is provided externally of a lower end edge thereof with a mounting collar 4 to be thermally mounted on a wall of a container (not shown) and on the outer surface of a tubular wall 1*a* with threads 5 threadedly engaged with the cap 3. Recesses 6 are provided in the inner surface of the tubular wall 1*a* at equally spaced intervals around the whole inner surface thereof.

Each recess 6 has the upper wall portion formed into a tapered wall 6*a* so that the recess width at the open end (in the figure, the upper end) of the tubular wall 1*a* is wider than the remainder of the recess, and the upper wall portion of the adjacent recesses 6 connect with each other. A shoulder 7 is provided at the lower portion of the recess 6.

The tubular blade 2 has a tubular wall 2*a* having an outside diameter substantially equal to an inside diameter of the tubular body 1, the tubular wall 2*a* having its lower end edge formed into a saw-tooth edge. A partitioning wall 8 is provided, at diametrally symmetrical position, on the outer surface of the tubular wall 2*a*, and an outward projection 10 is provided at the upper part of each longitudinal projection 9.

Figure 4:
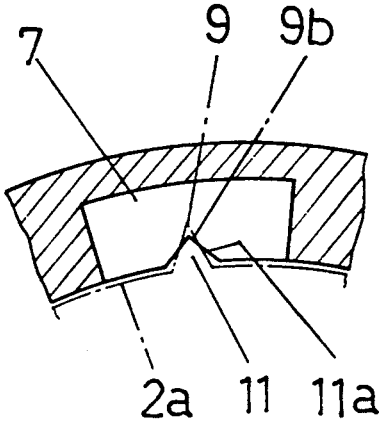
FIG. 4 is a sectional view for explaining the engagement between a tubular body and a tubular blade in the embodiment.

The shoulders 7 are provided so that when the tubular blade 2 is fitted into the tubular body 1, the lower end 9*a* of a longitudinal projection 9 and the corresponding outward projection 10 are opposed to a shoulder 7, each shoulder 7 having a triangular notch 11 provided substantially in a central portion thereof. The cross-sectional shape of each longitudinal projection 9 also has a substantially triangular shape, and the notch 11 and the longitudinal projection 9 are shaped so that, as shown in FIG. 4, edges 11*a* of the notch portion 11 are intersected by the end edges 9*b* of the longitudinal projection 9 with the apex of the projection 9 resting on shoulder 7.

The pouring plug for a container in the above-described embodiment is assembled by fitting the tubular blade 2 internally of the tubular body 1 and then threadedly engaging the cap 3 with the outside of the tubular body 1.

Figure 2:
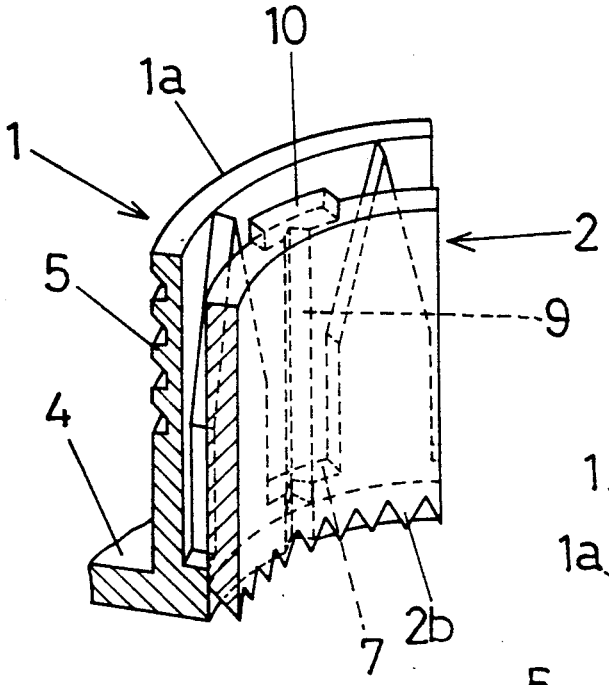
FIG. 2 is a partly sectional perspective view showing the assembled state of the embodiment.

In fitting the tubular blade 2 internally of the tubular body 1, first, the longitudinal projections 9 are fitted into and guided in corresponding recesses 6 provided in the inner surface of the tubular wall 1*a*, thus locating the tubular blade 2 and the tubular body 1 in a peripheral direction. When the inserting of the tubular blade 2 progresses and the lower ends 9*a* of the longitudinal projections 9 arrive at the shoulders 7 provided at the lower ends of the recesses 6, the apex of each lower end 9*a* is engaged with the corresponding shoulder 7 and the fitting of the tubular blade 2 stops in the position as shown in FIG. 2. In this state, the cap 3 is threaded onto the tubular body 1. Since the tubular blade 2 is temporarily fixed as described above, the saw-tooth edge 2*b* at the lower end of the tubular blade 2 is prevented from protruding from the lower end of the tubular body 1, and the mounting of mounting collar 4 on the container wall can be carried out smoothly without any trouble.

For opening the container by the pouring plug mounted on the container wall, the cap 3 is removed from the tubular body 1, and thereafter the tubular blade 2 is moved downward within the tubular body 1 to rupture a portion covering an opening of the container wall by the saw-tooth edge 2*b*.

Figure 3:
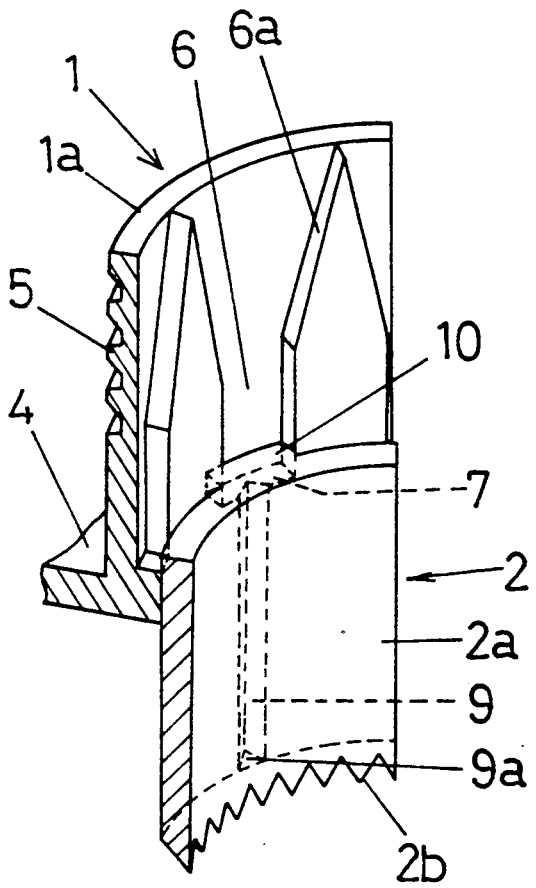
FIG. 3 is a partly sectional perspective view when the tubular blade has been moved down from the FIG. 2 position.

The tubular blade 2 is moved downward within the tubular body 1 by pushing the tubular blade 2 down with a finger tip or the like. In this case, the engagement between the lower end 9*a* of each longitudinal projection 9 and the corresponding shoulder is released by the cut edges 11*a* of notch 11 being deformed by the push-down force. When the tubular blade 2 is moved downward by the push-down force, the container wall is opened. The downward movement of the tubular blade 2 is stopped by abutment and engagement between the outward projections 10 and the shoulders 7 as shown in FIG. 3. The tubular blade 2 cannot be moved downward from that state, and the tubular blade 2 becomes temporarily fixed in that position to prevent the tubular blade 2 from falling into the container.

There is a further effect that since the upper portion of the recess is made wider, when the tubular blade is fitted into the tubular body and assembled, accurate locating can be obtained to facilitate automatic assembling.

There is another effect that the inner wall of the tubular body and the outer wall of the tubular blade are provided with longitudinal grooves and projections, thus making the molds simple.

Although the present invention has been described with particular reference to the several preferred embodiments thereof, it should be understood that various changes and modifications may be made without departing from the scope and spirit of the invention.

What is claimed is:

1. A pouring spout for a container, comprising:

a tubular body to be mounted on a container wall, the inner surface of said tubular body having a guiding recess therein extending parallel to the axis of said tubular body, said recess having a greater width at the portion thereof toward one end of said tubular body and a shoulder at an end corresponding to another end of said tubular body;

a tubular blade movably mounted within said tubular body and having a longitudinal projection on the outer surface thereof and an outward projection at the end of said longitudinal projection corresponding to said one end of said tubular body, the longitudinal projection being slidably engaged in said recess for guiding movement of said tubular blade into said tubular body in a direction from said one end toward said other end, said shoulder having a notch portion in an inner peripheral edge having a cross-sectional shape different from the cross-sectional shape of said longitudinal projection for blocking movement of said tubular blade in said direction at a set position within said tubular body by engagement of said longitudinal projection with said shoulder at the position of said notch portion, and said shoulder being deformable for permitting said longitudinal projection to fit into said notch and permit movement of said tubular blade in said direction past said set position until said outward projection engages said shoulder; and a cap mounted over said tubular body.

2. A pouring plug as claimed in claim 1 in which there is a plurality of recesses having the shape of said firstmentioned recess and spaced around the inner peripheral surface of said tubular body, and a plurality of longitudinal projections and outward projections having the shape of said firstmentioned longitudinal projection and outward projection and spaced around the outer periphery of said tubular blade.

* * * * *